US010689159B2

(12) United States Patent
Einhorn

(10) Patent No.: US 10,689,159 B2
(45) Date of Patent: Jun. 23, 2020

(54) SLURRY ICE CONTAINMENT SYSTEM AND METHOD

(71) Applicant: Mordechai Einhorn, Toronto (CA)

(72) Inventor: Mordechai Einhorn, Toronto (CA)

( * ) Notice: Subject to any disclaimer, the term of this patent is extended or adjusted under 35 U.S.C. 154(b) by 107 days.

(21) Appl. No.: 15/961,997

(22) Filed: Apr. 25, 2018

(65) Prior Publication Data

US 2018/0305087 A1 Oct. 25, 2018

Related U.S. Application Data

(60) Provisional application No. 62/489,743, filed on Apr. 25, 2017, provisional application No. 62/491,550, filed on Apr. 28, 2017.

(51) Int. Cl.

| | |
|---|---|
| ***B65D 27/08*** | (2006.01) |
| ***F25C 5/18*** | (2018.01) |
| ***B65D 27/06*** | (2006.01) |
| ***B65D 30/00*** | (2006.01) |
| ***B65D 27/00*** | (2006.01) |

(Continued)

(52) U.S. Cl.

CPC ..... *B65D 27/08* (2013.01); *B65D 27/005* (2013.01); *B65D 27/06* (2013.01); *B65D 29/00* (2013.01); *B65D 31/12* (2013.01); *B65D 75/5877* (2013.01); *B65D 75/5883* (2013.01); *B65D 85/78* (2013.01); *F25C 5/18* (2013.01); *F25C 2301/002* (2013.01); *F25D 2303/0822* (2013.01)

(58) Field of Classification Search

CPC ..... B65D 27/08; B65D 27/005; B65D 29/00; B65D 27/06; B65D 85/78; B65D 75/5883; B65D 75/5877; B65D 31/12; F25C 5/18; F25C 2301/002; F25C 1/02; F25D 2303/0822; F25D 31/002; A23F 5/243; A23G 9/045; A23G 9/46; C02F 1/22

See application file for complete search history.

(56) References Cited

U.S. PATENT DOCUMENTS

| | | | | |
|---|---|---|---|---|
| 3,238,002 | A | 3/1966 | O'Connell et al. | |
| 2006/0115573 | A1* | 6/2006 | Singer ..... | A23G 9/045 426/599 |
| 2015/0107292 | A1 | 4/2015 | Cousaert et al. | |

FOREIGN PATENT DOCUMENTS

| | | | |
|---|---|---|---|
| DE | 10045513 | B4 | 3/2002 |
| DE | 202013008318 | U1 | 11/2013 |

(Continued)

OTHER PUBLICATIONS

PCT/CA2018/050485, Written Opinion of the International Searching Authority and International Search Report, dated Jul. 19, 2018.

*Primary Examiner* — Emmanuel E Duke
(74) *Attorney, Agent, or Firm* — Bereskin & Parr LLP/S.E.N.C.R.L., s.r.l.

(57) ABSTRACT

There is provided a slurry ice containment system, and the method of providing same. This involves impeding separation of liquid and ice components of a slurry ice mixture, and more particularly relates to impeding the separation of liquid and frozen components of a slurry food product mixture, such as, for example, a slurry juice. This can be done by providing catches within a container. These catches may be of various size, shape, structure, and position. These catches hold ice crystal volume in various places within the container to assist in preventing the total volume of ice crystal to rise to the top of a container.

13 Claims, 3 Drawing Sheets

(51) Int. Cl.

| | |
|---|---|
| ***B65D 85/78*** | (2006.01) |
| ***B65D 75/58*** | (2006.01) |
| ***B65D 30/22*** | (2006.01) |

(56) References Cited

FOREIGN PATENT DOCUMENTS

| | | | |
|---|---|---|---|
| DE | 102013200744 | A1 | 7/2014 |
| WO | 209019251 | A1 | 2/2009 |
| WO | 2013153545 | A1 | 10/2013 |
| WO | 2014111526 | A1 | 7/2014 |

* cited by examiner

SLURRY ICE CONTAINMENT SYSTEM AND METHOD

CROSS-REFERENCE TO RELATED APPLICATION

This application claims the benefit of U.S. Provisional Patent Application No. 62/489,743 filed Apr. 25, 2017 and U.S. Provisional Patent Application No. 62/491,550 filed Apr. 28, 2017, the contents both of which are incorporated herein by reference.

FIELD OF THE INVENTION

The embodiments and methods disclosed herein relate generally to impeding separation of liquid and ice components of a slurry ice mixture, and more particularly relate to impeding the separation of liquid and frozen components of a slurry food product mixture, such as, for example, a slurry juice.

BACKGROUND OF THE INVENTION

Slurry ice mixtures can impede food spoilage of food products, for example by cooling the food product using slurry ice. There are advantages in using slurry ice mixtures for this purpose. For example, slurry ice mixtures can remain at substantially the same temperature provided the slurry ice mixtures retain a certain minimum fraction of both their frozen and liquid components. When heat is transferred into the slurry ice mixture, some of the frozen component of the slurry ice mixture can transition to the liquid component to absorb this heat without significantly changing the temperature of the slurry ice mixture. Conversely, when heat transfers out of the slurry ice mixture, some of the liquid component of the slurry ice mixture can transition to the frozen component to provide this heat transfer without significantly changing the temperature of the slurry ice mixture.

SUMMARY OF THE INVENTION

A system and method of slurry ice containment is provided. In some embodiments, this system provides catches within a container. These catches may be of various size, shape, structure, and position. These catches can hold ice crystal volume in various places within the container to impede at least some of the total volume of ice crystal from rising to the top of a container, which the ice crystals may otherwise tend to do as a result of these ice crystals or frozen components being less dense than the liquid components.

In accordance with an embodiment of the present invention, there is provided a container comprising: an external base for supporting the container on a support surface; a container membrane defining a hollow interior having a storage volume for containing a slurry mixture comprising a liquid component and a frozen component, the container membrane comprising a bottom membrane and a top membrane such that when the external base supports the container on a substantially horizontal support surface, the hollow interior extends vertically from the bottom membrane to the top membrane; at least one catch surface for impeding migration of the frozen component of the slurry mixture toward the top membrane, the at least one catch surface being attached to the container membrane and located between the bottom membrane and the top membrane; and, an inlet/outlet port for providing the slurry mixture to the hollow interior and for draining the slurry mixture from the hollow interior.

In some embodiments, the at least one catch surface and the bottom membrane define a total catch volume including, for each catch surface in the plurality of catch surfaces, a component catch volume extending vertically from the bottom membrane to that catch surface, the total catch volume being at least 30% of the storage volume.

In some embodiments, the total catch volume is at least 50% of the storage volume.

In some embodiments, the at least one catch surface comprises a surface of a mesh fabric barrier located between the bottom membrane and the top membrane, the mesh fabric barrier being i) permeable by the liquid component of the slurry mixture and ii) impermeable to most of the frozen component of the slurry mixture.

In some embodiments, the mesh fabric barrier divides the hollow interior into an upper interior space between the mesh fabric and the top membrane, and a lower interior space between the mesh fabric and the bottom membrane.

In some embodiments, the mesh fabric barrier comprises a supply opening for supplying the slurry mixture to the upper interior space and the lower interior space, and for draining the slurry mixture from the upper interior space and the lower interior space.

In some embodiments, the mesh fabric barrier is one of a plurality of mesh fabric barriers dividing the hollow interior into at least three interior spaces extending from the bottom membrane to the top membrane.

In some embodiments, the at least one catch surface comprises a plurality of catch surfaces, each catch surface in the plurality of catch surfaces defining a catch region and being angled to guide a portion of the frozen component rising toward the top membrane and contacting that catch surface to the catch region, wherein the catch region blocks the portion of the frozen component from rising further toward the top membrane.

In some embodiments, the at least one catch surface in the plurality of catch surfaces comprises two distal edges, the catch surface being sloped toward the top membrane to a central portion located between the two distal edges and closer to the top membrane than the two distal edges, the central portion providing the catch region for blocking the portion of the frozen component from rising further toward the top membrane.

In accordance with an embodiment of the present invention there is provided a product comprising a container as described in any one of the above embodiments and a slurry mixture comprising a liquid component and a frozen component.

In some embodiments, at least 50% of the frozen component of the slurry mixture is separated from the top membrane by some of the liquid component of the slurry mixture and the at least one catch surface.

In accordance with an embodiment of the present invention, there is provided a method of containing a slurry mixture, the method comprising: supplying a slurry mixture to a hollow interior of a container, the slurry mixture comprising a liquid component and a frozen component, and the interior of the container comprising a bottom membrane and a top membrane; supporting the container on a support surface such that the hollow interior extends vertically from the bottom membrane to the top membrane; and blocking migration of a portion of the frozen component of the slurry mixture toward the top membrane by providing at least one catch surface between the bottom membrane and the top membrane to block the portion of the frozen component from rising toward the top membrane, and to separate the portion of the frozen component from the top membrane by some of the liquid component of the slurry mixture and the at least one catch surface.

In some example methods, the portion of the frozen component of the slurry mixture blocked by the at least one catch surface is at least 50% of the frozen component of the slurry mixture.

BRIEF DESCRIPTION OF THE DRAWINGS

The drawings included herewith are for illustrating various examples of articles, methods, and apparatuses of the present specification. In the drawings.

DETAILED DESCRIPTION OF PREFERRED ASPECTS OF THE INVENTION

Figure 1:
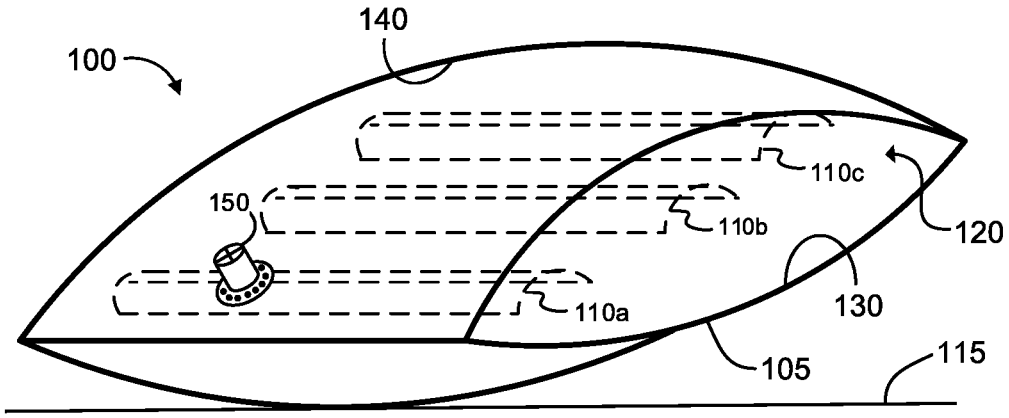
FIG. 1 is a perspective view of a container containing catches in accordance with an embodiment of the present invention.

The embodiments illustrated and described herein provide individual, non-limiting, examples in which the principles of the present invention are employed. It is possible to make other embodiments that employ the principles of the invention and that fall within the following claims. To the extent that the features of those examples are not mutually exclusive of each other, the features of the various embodiments may be mixed-and-matched, i.e., combined, in such manner as may be appropriate, without having to resort to repetitive description of those features in respect of each possible combination or permutation. The invention is not limited to the specific examples or details, which are given by way of illustration herein, but only by the claims, as mandated by law. The claims are to be given the benefit of purposive interpretation to include equivalents under the doctrine of equivalents.

In the description, like parts are marked throughout the specification and the drawings with the same respective reference numerals and, where applicable, with numbers incremented by 100 referring to like parts in a previously labeled embodiment. The wording used herein is intended to include both singular and plural where such would be understood, and to include synonyms or analogous terminology to the terminology used, and to include equivalents thereof in English or in any language into which this specification many be translated, without being limited to specific words or phrases.

Ice crystals in an ice slurry may stratify and may tend to float to the surface of a container containing an ice slurry. The ice crystals may then gradually accumulate at the top of the container. The buoyancy of successive layers of ice may also compact the ice layers, as ice crystals forced towards the surface drive against ice crystals above.

Aqueous solutions may include liquid food and beverage solutions. These liquid food and beverage solutions may contain a water mixture with any known freeze suppressant such as sugar, alcohol, or salt. The water portion of these aqueous solutions may be cooled to provide a pumpable slurry ice solution. Such a transformation may permit the aqueous solutions to be transported for extended periods of time without the need for mechanical refrigeration such as external eutectic holdover, or the need for internally injected medium such as ice, CO2 or liquid nitrogen to maintain desired temperatures.

Current methods used to transport perishable liquid products transformed into pumpable slurry ice solutions include tanks, flexitanks, tankers, drums, and bags of different sizes and shapes.

An aqueous solution containing one or more freeze suppressants may be transformed into a slurry-ice mixture. The desired temperature of the mixture can be maintained for a controllable time period by controlling the amount of ice fraction in the mixture.

Slurry ice may be produced by freezing only a mixture's water molecules a few degrees below the freezing temperature of water. The mixture's freeze suppressant may then act as a temperature hold over eutectic solution, to maintain the mixture's temperature when in transport.

Since slurry ice density decreases with an increase in ice fraction, slurry ice crystals may stratify and float to the top of a slurry ice mixture. This may result in temperature stratification within the mixture, in which the top levels of the mixture may be cooler than the bottom levels. Such a temperature stratification may result in temperatures that are warmer than is desired during transport, especially in the bottom levels of the mixture.

In some situations the agitation of the mixture caused by the movement of a transport vehicle during transport, such as the jostling of a moving truck or train, may prevent prolonged stratification of the mixture. However, in other situations during transport a mixture may remain un-jostled for a period of time: for example the mixture may remain un-jostled for a period of time when offloaded from one transportation vehicle and not yet loaded onto another or while being transported by a vehicle such as a ship, which may not jostle cargo sufficiently to prevent stratification of the mixture over a prolonged period of time.

To help maintain uniform temperatures within the mixture, the vessel containing a slurry ice mixture may incorporate designs to prevent, impede or minimize slurry ice crystal stratification, by, for example, slurry ice crystals floating to the top of a vessel.

Some embodiments of the invention provide catches in containers, such as flexitank containers. Containers may comprise catches, such as concave downward catches or shoots. These catches may be provided to hold ice crystals of a slurry. The catches may contain and thus retain portions of slurry ice as the slurry ice crystals float upward. These catches may hold ice crystals, which may thus remain near the bottom of the container. Retaining ice crystals near the bottom of the container may maintain cooling at lower levels of the container.

In some embodiments, catches may be formed of solid, substantially non-porous fabric to ensure ice crystals of all sizes are held. In other embodiments, catches may be formed of fine mesh fabric to ease the movement of fluids through the catch and within the container. Both of these catch variants may be anchored or attached to an exterior membrane of the container. Where the catch is formed of a fine mesh fabric, it may extend across the entire hollow interior of the container dividing the hollow interior into an upper interior space and a lower interior space. Liquid and very fine particulate matter, such as very small ice crystals, may be able to traverse the fine mesh fabric, while larger ice crystals may not, such that larger ice crystals in the lower interior space can be retained in the lower interior space. The fine mesh catches may also prevent pulp, in juice, from either rising entirely to the top or settling entirely to the bottom, as the fine mesh catches may capture this pulp as well. Optionally, a plurality of catches formed of fine mesh fabric may extend across the entirety of the container, dividing the hollow interior into more than two interior spaces extending between the bottom and top of the hollow interior. In other embodiments, a catch may be formed of a hard fabric or material to provide a defined shape during transportation. In other embodiments, a catch may be formed of a flexible fabric or material so as not to interfere with any flexibility of the container or the movement of the slurry ice mixture within the container. In some embodiments, catches may be formed of a combination of materials to capture multiple benefits, including a combination of hard and flexible fabrics to provide partial structure to a catch. Where the catches are formed of a hard fabric, a flexible fabric, or a combination of materials, they may also prevent, to varying degrees, pulp, in juice, from rising to the top of the container.

The container may comprise a plurality of catches, which may be staggered catches. The container may comprise a single large catch. Containers comprising a series of catches may comprise catches at various heights in the container; alternatively, catches may be provided only near the base of a container. In some embodiments, a series of catches may be provided along a single height in the container. In other embodiments, multiple series of catches may be provided at multiple heights in the container. In other embodiments a single large catch may be provided.

In some embodiments, a catch may be of any shape or form. For example, a catch may be a pocket substantially longer then wide and may be formed by securing two sides of a piece of fabric to the base of a container. In some embodiments, a catch may include at least one opening to the larger volume of a container to permit ice crystals to move into the container. In some embodiments, an opening to the catch may face away from the side of the container, which will be the top of the container during transportation of the container.

In some embodiments, a container may comprise a plurality of catches and each catch may define at least one opening to an interior of the catch. In these embodiments, the openings may not all face the same side of the container, such that at least one catch can hold ice crystals regardless of which side of the container is the top of the container during transportation.

In some embodiments, a catch or system of catches may be of sufficient size to hold a predetermined amount or percentage of ice crystal volume. This may permit a user to better control the stratification of the ice crystal volume.

In some embodiments, the catches may be of different sizes and define different volumes to permit a different volume of ice crystal to be maintained at different heights and locations within the container.

In some embodiments, a catch may be substantially free floating in the container, and may be anchored to one or more sides of the container. This can be implemented with either a mesh or solid catch. Such a free-floating catch can be attached to the sides of the container at multiple edges or corners to define peripheral passages connecting the different levels divided by these catches. A free-floating catch may automatically assume a somewhat concave configuration, as the tendency of the frozen component of the slurry captured by it may tend to force the catch up, while the attaching cords, for example, attaching it to the internal side of the membrane of the container, may tend to hold the catch down. Slack or elasticity in the cords attaching the free-floating catch to the sides or corners of the container can facilitate the free-floating catch assuming a somewhat concave configuration, allowing these cords to be straightened or stretched when the free-floating catch is assuming the concave configuration.

In some embodiments, the catches may be free-floating at one end, say at the end having the internal/external port, while being anchored to the wall at the other end, such that the only peripheral passages connecting the interior spaces separated by the catches are close to the internal/external port. Then, when the container is supported by its external base, so that the top membrane is vertically spaced from the bottom membrane, slurry can be supplied to the container via the internal/external port. This can fill the first interior space below the bottommost catch, and can then, successively fill each of the upper interior spaces. The anchoring of the catches can be spaced apart in such a manner that during filling and emptying, the catches may not contact each other to interfere with filling one of the interior spaces.

In some embodiments, a catch may extend substantially the entire width or length or height of a container. In a further embodiment a container may be substantially divided into compartments of similar or varying size by catches of similar or varying size.

In addition to the exterior membrane, there can be interior membranes, which, in use, can extend in a roughly horizontal direction. They can be held in this horizontal orientation by the inflation of the exterior membrane by filling it with the slurry ice mixture, as there may be insufficient slack in these membranes to permit them to sag significantly in the middle.

In some embodiments, holes can be provided in the interior membranes to permit slurry ice to move between the different cavities defined by the interior and exterior membranes. However, over much of the area of the interior membranes, ice crystals may be unable to traverse the membrane to move from one cavity to another. This can impede upward migration of ice crystals thereby impeding a temperature gradient from developing, where the top of the slurry ice container is much colder than the bottom due to upward migration of ice crystals.

Preferably, the holes provided in the interior membranes may be provided close to an inlet through which slurry ice is supplied to the container. Alternatively, separate inlets may be provided to each cavity, such that the interior membranes define a substantially impermeable barrier to ice crystals.

In some embodiments, two interior membranes may be provided to define three cavities: a top cavity between the top exterior membrane and the top interior membrane; a middle cavity between the top interior membrane and the bottom interior membrane; and, a bottom cavity between the bottom interior membrane and the bottom exterior membrane. In other embodiments, different numbers of interior membranes may be provided, to provide different numbers of cavities.

In some embodiments, the exterior membrane can comprise 2-3 layers of a very strong polymer film, which can be stretched to many times its initial area without breaking. The film can be a food grade polymer, whether a blown film or extruded individual sheets. In some embodiments, the film is a polyethylene film. In some embodiments, the polymer film container may be itself contained within a more rigid structure or frame to help retain its shape.

Referring to FIG. 1, there is illustrated a container 100 comprising catch surfaces 110 in accordance with an embodiment of the present invention. Container 100 can be supported by an external base 105. Container 100 has an exterior membrane surrounding a hollow interior 120. The hollow interior 120 defines a storage volume for containing a slurry mixture comprising a liquid component and a frozen component. The exterior membrane may comprise a bottom membrane 130 and a top membrane 140 such that when the external base supports container 100 on a substantially horizontal support surface 115, the hollow interior 120 can extend vertically from the bottom membrane 130 to the top membrane 140. In FIG. 1, three catch surfaces 110*a*, 110*b*, and 110*c* are shown in the container 100 for impeding migration of the frozen component of the slurry mixture toward the top membrane 140, but the container may include many more catch surfaces. The catch surfaces 110 can be located between the bottom membrane 130 and the top membrane 140, and may be attached to the exterior membrane to hold them in place within the hollow interior 220. An inlet/outlet port 150 is shown located on the top membrane 140, but may be located elsewhere on the container 100, such as on the bottom membrane 130, or even on a side or a seam of the container 100. Inlet/outlet port 150 can be used to provide the slurry mixture to the hollow interior 120 and to drain the slurry mixture from the hollow interior 120.

Figure 2:
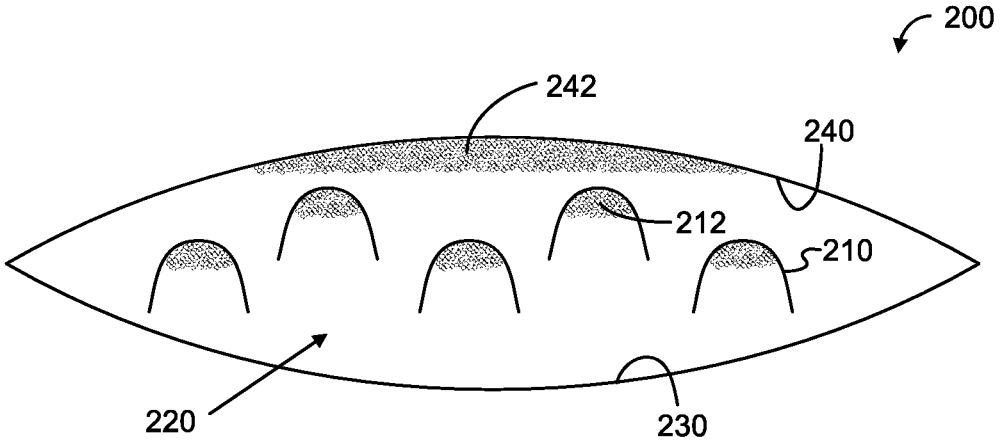
FIG. 2 is a side view of a container comprising catches in accordance with an embodiment of the present invention, showing ice crystals captured by catches and held below an ice pack formed near the surface of the container.

Referring to FIG. 2, there is illustrated a container 200 comprising catches 210 in accordance with an embodiment of the present invention. FIG. 2 shows ice crystals 212 captured by the catches 210 and held below an ice pack 242 formed near the surface of the container, such that a liquid component of the slurry mixture separates the ice crystals 212 captured by the catches 210 from the ice pack 242. Container 200 has an exterior membrane surrounding a hollow interior 220. The hollow interior 220 defines a storage volume for containing the slurry mixture. The exterior membrane may comprise a bottom membrane 230 and a top membrane 240. In FIG. 2, five catches 210 are shown in the container 200 for impeding migration of the frozen component of the slurry mixture toward the top membrane 240. The catches 210 can be located between the bottom membrane 230 and the top membrane 240, at various distances from the bottom membrane 230, and may be attached to the exterior membrane to hold them in place within the hollow interior 220.

Figure 3:
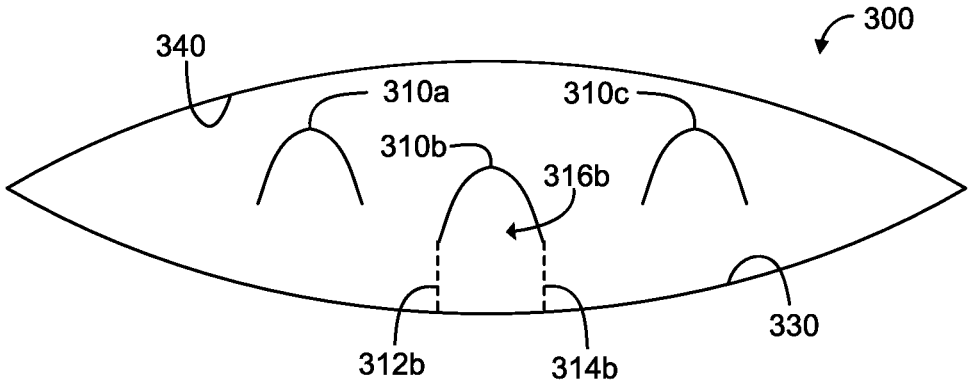
FIG. 3 is a side view of a container comprising catches in accordance with an embodiment of the present invention, showing the volume of slurry beneath a catch in which ice crystals will rise to the catch and not to the surface of the container.

Referring to FIG. 3, there is illustrated a container 300 comprising catches 310 in accordance with an embodiment of the present invention. Imaginary lines, shown dashed and designated 312*b* and 314*b*, have been superimposed to indicate the boundaries of a volume of slurry 316*b* beneath a catch 310*b*. Ice crystals within the volume of slurry 316*b* (between dashed lines 312*b* and 314*b*) can rise to catch 310*b* but not beyond to the top membrane 340. Left boundary 312*b* and right boundary 314*b* show the left and right boundaries of the volume of slurry 316*b*, ice crystals from which are likely to be caught by catch 310*b* after rising. The volume of slurry 316*b* is the component catch volume from one catch. The total catch volume can be determined by summing all of the component catch volumes 316 for all of the catches 310. The total catch volume can then represent the total volume of slurry within which ice crystals are likely to be caught by the catches 310.

Figure 4:
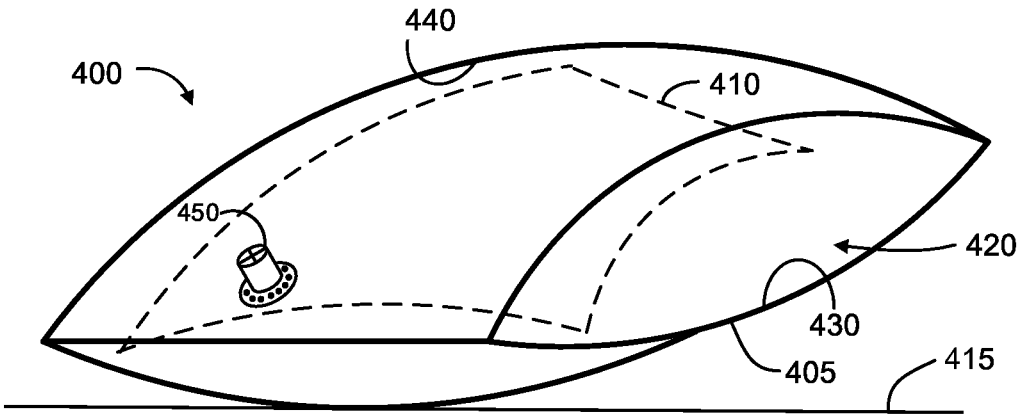
FIG. 4 is a perspective view of a container in accordance with another aspect of an embodiment of the present invention.

Referring to FIG. 4, there is illustrated a container 400 comprising a catch surface 410 in accordance with an embodiment of the present invention. Container 400 can be supported by an external base 405. Container 400 has an exterior membrane surrounding a hollow interior 420. The hollow interior 420 defines a storage volume for containing a slurry mixture comprising a liquid component and a frozen component. The exterior membrane may comprise a bottom membrane 430 and a top membrane 440 such that when the external base supports container 400 on a substantially horizontal support surface 415, the hollow interior 420 can extend vertically from the bottom membrane 430 to the top membrane 440. In FIG. 4, one catch surface 410 is shown in the container 400 for impeding migration of the frozen component of the slurry mixture toward the top membrane 440. The catch surface 410 can be located between the bottom membrane 430 and the top membrane 440. An inlet/outlet port 450 is located on the top membrane 440, but may be located elsewhere on the container 400, such as on the bottom membrane 430, or even on a side or a seam of the container 400. Inlet/outlet port 450 can be used to provide the slurry mixture to the hollow interior 420 and to drain the slurry mixture from the hollow interior 420.

Figure 5:
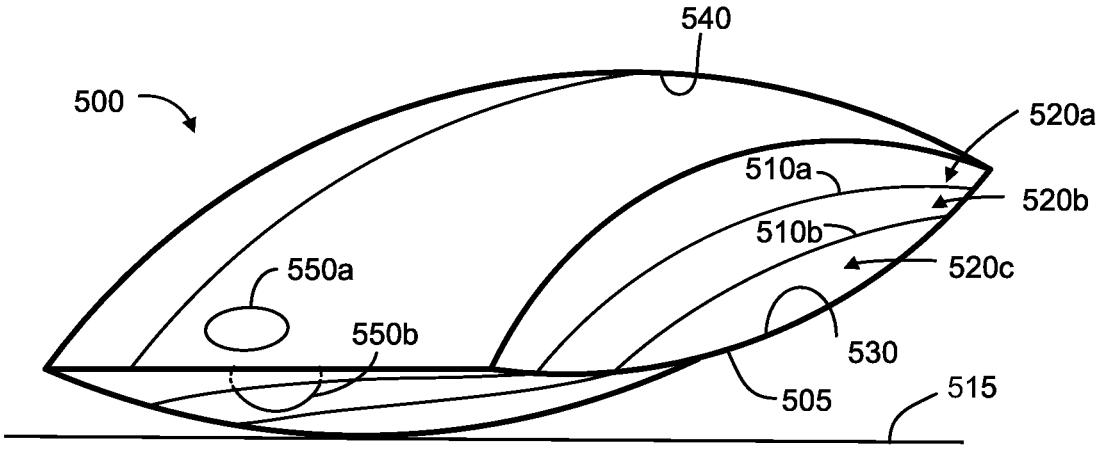
FIG. 5 is a perspective view of a container in accordance with an embodiment of the present invention, in which interior membranes are provided to impede upward migration ice crystals.

Referring to FIG. 5, there is illustrated a container 500 in accordance with an embodiment of the present invention, in which interior membranes are provided to impede upward migration of ice crystals. In this example embodiment, container 500 may comprise two interior membranes 510*a* and 510*b* in the container for impeding migration of the frozen component of the slurry mixture toward the top membrane 540. Container 500 can be supported by an external base 505. The top membrane 540 and interior membrane 510*a* surround a hollow interior 520*a*. Interior membrane 510*a* and interior membrane 510*b* surround a hollow interior 520*b*. Interior membrane 510*b* and a bottom membrane 530 surround a hollow interior 520*c*. Hollow interiors 520*a*, 520*b*, and 520*c* together define a total storage volume for containing a slurry mixture comprising a liquid component and a frozen component. The external base 505 can support container 500 on a substantially horizontal support surface 515, such that the hollow interiors 520 can extend vertically from the bottom membrane 530 to the top membrane 540. In FIG. 5, two interior membranes 510*a* and 510*b* are shown in the container 500 for impeding migration of the frozen component of the slurry mixture toward the top membrane 540. The interior membranes 510 can be located at different heights between the bottom membrane 530 and the top membrane 540. Two internal passages 550*a* and 550*b* are shown located on interior membranes 510*a* and 510*b*. These internal passages can provide fluid communication between the hollow interiors 520*a*, 520*b*, and 520*c*, particularly when the container 500 is being filled with slurry via an inlet/outlet port (not shown), or when slurry is being drained from the container 500 via the inlet/outlet port.

In accordance with an embodiment of the present invention there is provided a product comprising a container as described in any one of the above embodiments, including those illustrated in FIGS. 1-5, and a slurry mixture comprising a liquid component and a frozen component. The slurry component could, for example, be a slurry juice product including a frozen component and a liquid component.

Figure 6:
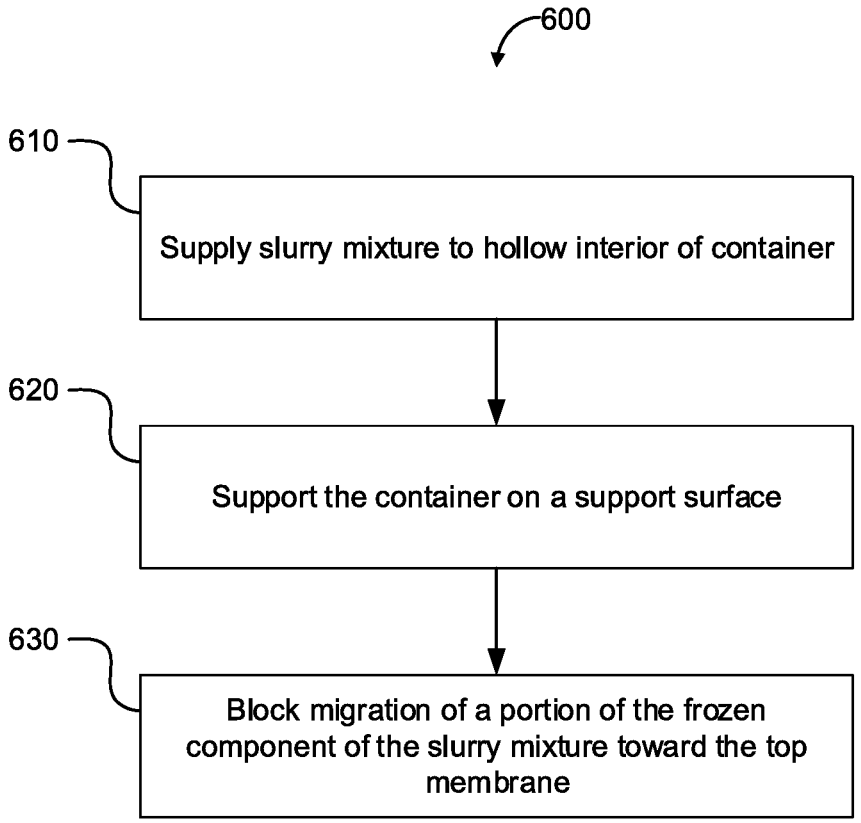
FIG. 6 is a flowchart illustrating a method of containing a slurry mixture in accordance with a preferred aspect of an embodiment of the present invention.

Referring to FIG. 6, there is illustrated in a flowchart a method 600 of containing a slurry mixture in accordance with an aspect of an embodiment of the present invention. The method 600 can begin with step 610, in which a slurry mixture is supplied to a hollow interior 120 of a container 100, the slurry mixture comprising a liquid component and a frozen component, and the interior of the container comprising a bottom membrane 130 and a top membrane 140.

At step 620, the container 100 can be supported on a support surface such that the hollow interior 120 extends vertically from the bottom membrane 130 to the top membrane 140.

At step 630, migration of a portion of the frozen component of the slurry mixture toward the top membrane 140 can be blocked by providing at least one catch surface 110 between the bottom membrane 130 and the top membrane 140 to block the portion of the frozen component from rising toward the top membrane 140, and to separate the portion of the frozen component from the top membrane 140 by some of the liquid component of the slurry mixture and the at least one catch surface 110.

In another embodiment, the portion of the frozen component of the slurry mixture blocked by the at least one catch surface 110 can be at least 50% of the frozen component of the slurry mixture.

Numerous specific details are set forth herein in order to provide a thorough understanding of the exemplary embodiments described herein. However, it will be understood by those of ordinary skill in the art that there embodiments may be practices without these specific details. In other instances, well-known methods, procedures and components have not been described in detail so as not to obscure the description of the embodiments. Furthermore, this description is not to be considered as limiting the scope of these embodiments in any way, but rather as merely describing the implementation of these various embodiments.

The invention claimed is:

1. A container comprising:

an external base for supporting the container on a support surface;

a container membrane defining a hollow interior having a storage volume for containing a slurry mixture comprising a liquid component and a frozen component, the container membrane comprising a bottom membrane and a top membrane such that when the external base supports the container on a horizontal support surface, the hollow interior extends vertically from the bottom membrane to the top membrane;

at least one catch surface for impeding migration of the frozen component of the slurry mixture toward the top membrane, the at least one catch surface being attached to the container membrane and located between the bottom membrane and the top membrane; and, an inlet/outlet port for providing the slurry mixture to the hollow interior and for draining the slurry mixture from the hollow interior.

2. The container as defined in claim 1 wherein the at least one catch surface and the bottom membrane define a total catch volume including, for each catch surface in the plurality of catch surfaces, a component catch volume extending vertically from the bottom membrane to that catch surface, the total catch volume being at least 30% of the storage volume.

3. The container as defined in claim 2 wherein the total catch volume is at least 50% of the storage volume.

4. The container as defined in claim 1 wherein the at least one catch surface comprises a surface of a mesh fabric barrier located between the bottom membrane and the top membrane, the mesh fabric barrier being i) permeable by the liquid component of the slurry mixture and ii) impermeable to most of the frozen component of the slurry mixture.

5. The container as defined in claim 4 wherein the mesh fabric barrier divides the hollow interior into an upper interior space between the mesh fabric and the top membrane, and a lower interior space between the mesh fabric and the bottom membrane.

6. The container as defined in claim 5 wherein the mesh fabric barrier comprises a supply opening for supplying the slurry mixture to the upper interior space and the lower interior space, and for draining the slurry mixture from the upper interior space and the lower interior space.

7. The container as defined in claim 5 wherein the mesh fabric barrier is one of a plurality of mesh fabric barriers dividing the hollow interior into at least three interior spaces extending from the bottom membrane to the top membrane.

8. The container as defined in claim 1 wherein the at least one catch surface comprises a plurality of catch surfaces, each catch surface in the plurality of catch surfaces defining a catch region and being angled to guide a portion of the frozen component rising toward the top membrane and contacting that catch surface to the catch region, wherein the catch region blocks the portion of the frozen component from rising further toward the top membrane.

9. The container as defined in claim 8 wherein the at least one catch surface in the plurality of catch surfaces comprises two distal edges, the catch surface being sloped toward the top membrane to a central portion located between the two distal edges and closer to the top membrane than the two distal edges, the central portion providing the catch region for blocking the portion of the frozen component from rising further toward the top membrane.

10. A product comprising:

a) the container as defined in any one of claims 1-9; and b) a slurry mixture comprising a liquid component and a frozen component.

11. The product as defined in claim 10 wherein at least 50% of the frozen component of the slurry mixture is separated from the top membrane by some of the liquid component of the slurry mixture and the at least one catch surface.

12. A method of containing a slurry mixture, the method comprising:

supplying a slurry mixture to a hollow interior of a container, the slurry mixture comprising a liquid component and a frozen component, and the interior of the container comprising a bottom membrane and a top membrane;

supporting the container on a support surface such that the hollow interior extends vertically from the bottom membrane to the top membrane;

blocking migration of a portion of the frozen component of the slurry mixture toward the top membrane by providing at least one catch surface between the bottom membrane and the top membrane to block the portion of the frozen component from rising toward the top membrane, and to separate the portion of the frozen component from the top membrane by some of the liquid component of the slurry mixture and the at least one catch surface.

13. The method as defined in claim 12 wherein the portion of the frozen component of the slurry mixture blocked by the at least one catch surface is at least 50% of the frozen component of the slurry mixture.

* * * * *